US005086811A

United States Patent [19]

Suhr

[11] Patent Number: 5,086,811

[45] Date of Patent: Feb. 11, 1992

[54] FLEXIBLE CABLE INTERMEDIATE SUPPORT WITH RIGID HOLLOW TUBE FOR A HEDDLE FRAME

[76] Inventor: Robert N. Suhr, 431 Chowning Pl., Marietta, Ga. 30064

[21] Appl. No.: 558,230

[22] Filed: Jul. 26, 1990

[51] Int. Cl.[5] ..... D03C 9/06

[52] U.S. Cl. ..... 139/91

[58] Field of Search ..... 403/291, 388; 52/426, 52/223 L, 808, 227, 228, 408, 410, 729, 230, 787; 249/215, 216, 217; 139/91, 92

[56] References Cited

U.S. PATENT DOCUMENTS

| | | | |
|---|---|---|---|
| 1,637,796 | 8/1927 | Andrews | 139/91 |
| 1,645,571 | 10/1927 | Andrews | 139/91 |
| 1,767,834 | 6/1930 | Carlson | 249/217 |
| 1,820,509 | 8/1931 | Toogood | 249/216 X |
| 3,937,607 | 2/1976 | Rodormer | 52/223 L X |
| 3,965,543 | 6/1976 | Connors | 52/223 L X |
| 4,598,519 | 7/1986 | Reid | 52/426 |
| 4,924,916 | 5/1990 | Faasse et al. | 139/91 |

*Primary Examiner*—Andrew M. Falik
*Attorney, Agent, or Firm*—Harry I. Leon

[57] ABSTRACT

An intermediate support for a weaving heddle frame in which the support carries both tensile and compressive forces between the upper and lower frame staves. The support can be disengaged from the lower frame stave simply by loosening a fastener at the top of the support and can then be swung upwardly to clear the space between the two frame staves. The support comprises a flexible cable, surrounded by at least three rigid hollow segments. In use, the lower end of the cable is inserted into a slot in the lower frame stave and the upper end of the cable into a slot in the upper frame stave. The two slots are aligned vertically. The cable is tensioned by the use of a plug which is connected to the upper end of the cable and which threadedly engages nuts attached to the upper frame stave. When tension is applied to the cable, the lower stave is urged upward into contact with the lower end of the rigid hollow member and the upper stave is urged downward into contact with the upper end of the rigid hollow member. Tension forces in the cable and the compressive forces in the rigid hollow member hold the upper and lower staves in a predetermined parallel relationship. When the cable is loosened sufficiently. The segments forming the rigid hollow member separate, allowing the support to be bent out of the way.

8 Claims, 2 Drawing Sheets

FLEXIBLE CABLE INTERMEDIATE SUPPORT WITH RIGID HOLLOW TUBE FOR A HEDDLE FRAME

BACKGROUND OF THE INVENTION

1. Field of the Invention

This invention relates to weaving and more particularly to an improved flexible intermediate support for a weaving heddle frame.

2. Discussion of the Prior Art

As is well known, weaving comprises interlacing warp and filling yarns according to a predefined pattern. Each individual warp yarn is threaded through a heddle. The heddles are held in a weaving heddle frame. Each frame can be raised or lowered as desired, thus controlling the position of its heddles and warp yarn. That is, each respective set of warp yarns controlled by one of the frames can be raised or lowered relative to the other sets of warp yarns. A shuttle motion is used to pass the filling yarn under the warp yarns that have been raised by the frames and to pass it over those warp yarns that have been lowered by the remaining frames. The process is repeated with the frames being shifted so as to raise new sets of warp yarns and lower others between successive passes of the shuttle until the fabric is woven.

Weaving heddle frames, presently in industrial use, have upper and lower frame staves between which one or more intermediate supports extend. The number of intermediate supports required depends on the length of the weaving heddle frame. The intermediate supports stabilize the frames as they move up and down while weaving, insuring that the upper and lower staves of each frame remain parallel and the desired distance apart so that the heddles do not bind and can slide freely on them.

None of the intermediate supports in the prior art is readily slideable on the staves; and in some instances, the supports must be entirely removed in order to relocate them and allow the heddles to slide properly. Unfortunately, weaving heddles take their final position only after the commencement of a weaving process. If the intermediate support is of a fixed position design, the support must be completely removed to allow the heddles and yarn ends to pass by it; and it must then be reinstalled. On the other hand, if the intermediate support is of a slideable design, fasteners on both the top and the bottom of the support must be loosened before it can be slid to the desired position and then secured in place again. In either case, removing or sliding intermediate supports is a time-consuming and difficult task in part because of the many fasteners which must be loosened and then tightened on both the upper and lower frame staves. Moreover, special tools are frequently required as well.

The problems which arise in connection with the installation and removal of the intermediate supports are compounded by facts that the number of weaving heddle frames in a weaving heddle loom is large, ranging from six to thirty-two. Further, the frames are very close together. To gain access to an intermediate support, the operator must spread the top frame staves apart and reach down between the frames to loosen or tighten the required fasteners.

Rigid intermediate supports for weaving heddle frames are shown in U.S. Pat. Nos. 4,658,864, 4,635,685, 3,417,790, 2,909,199, and 2,037,381. Various problems involved in the installation and removal of such intermediate supports are disclosed in these patents. In particular, U.S. Pat. No. 4,658,864 shows an intermediate support having threaded screws which are located on the underside of the lower frame stave making them almost inaccessible. U.S. Pat. No. 4,635,685 also shows a combination in which two screws must be replaced on the lower stave. A slideable intermediate support shown in U.S. Pat. No. 3,417,790 is held in position by two screws on the lower stave as well as two on the underside of the upper stave. Relocating this support presents an added problem in that guides to insure that it is being secured in a vertical position, perpendicular to the staves, are missing.

Other rigid intermediate supports are disclosed in U.S. Pat. Nos. 2,909,199 and 2,037,381. The latter support comprises a rigid rod surrounded by a hollow tube. The rigid rod must be raised completely in order to remove the tube and allow the heddles to slide by. U.S. Pat. No. 2,909,199 also discloses a rigid rod which must be raised through the upper frame stave to allow the heddles to slide past the intermediate support.

U.S. Pat. No. 4,475,574, on the other hand, shows a flexible intermediate support connected to the heddle carrying rods; but this support is not fixedly mounted on the frame staves and transmits only tensile forces between the rods.

SUMMARY OF THE INVENTION

In accordance with the present invention, there is provided an improved intermediate support for a weaving heddle frame that carries both tensile and compressive forces between the upper and lower frame staves, in which the lower end of the support is easily connected to or removed from the lower frame stave and which lacks any fasteners which must be loosened or tightened under the upper frame stave.

The improved intermediate support comprises a flexible cable on which is strung a segmented, rigid hollow member. Means mounted at the top of the upper frame stave and connected to the upper end of the cable is provided for tensioning the cable. The cable is connected to the upper and lower frame staves of a weaving heddle frame and retained in position perpendicular to these staves with the use of slotted holders fixedly attached to staves. The slotted holder on the lower stave is also employed to retain an end plug connected to the cable when the tensioning means is used to apply tension to the cable.

When tension is so applied, the end plug abuts the contiguous slotted holder, lifting the lower frame stave upwardly and into contact with the lower end of the rigid hollow member where it encircles the cable. Simultaneously, the upper frame stave is forced downwardly and into contact with the upper end of the rigid hollow member. Thus in use, the cable transmits a tensile force while the rigid hollow member carries a compressive force, as required to maintain the upper and lower frame staves in a desired predetermined parallel relationship with each other so that the heddle can slide freely, without binding, along heddle carrying rods of the weaving heddle frame.

In the present invention, the rigid hollow member comprises at least three rigid hollow segments which together form a rigid hollow member which can be bent. Two segments on the distal ends of the rigid hollow member are sufficiently short to allow the cable to be swung upwardly above the warp yarn so that the intermediate support need not be removed from the frame in order to adjust the position of the heddles at the start of a particular weaving process. The only fasteners on the intermediate support which must be alternately loosened and tightened are those disposed in the tensioning means on the top of the upper frame stave, making the fasteners easily accessible.

The ends of contiguous segments of the rigid hollow member are shaped so that each one can be nested in the other. These nestable ends are sized and shaped to insure that when the cable is under tension, the longitudinal axes of the segments are aligned with each other. Moreover, each of the junctures between segments forming the rigid hollow member preferably presents a smooth surface to the warp ends that are in contact with it.

In the preferred embodiment, both of the slotted holders have a plurality of slots. Pairs of slots disposed in the two holders are aligned vertically with each other, so that when the cable is retained during use within such a pair of slots, the cable and rigid hollow member are oriented in an manner which is perpendicular to the two frame staves, eliminating the need for time-consuming adjustments on the part of an installer.

The plurality of slots on each of the holders also provides for repositioning the intermediate support transversely along the frame staves.

When some of the heddles carrying warp yarn must be moved from one side to the other of the intermediate support according to the present invention, the operator need not remove the cable and hollow member. Rather he simply loosens the upper tensioning device to allow the cable to drop downwardly until the end plug can be freed from the lower slotted holder. He can then flex the cable at a lower joint of the rigid hollow member, bending it enough to pass the intermediate support over the lower heddle carrying rod before swinging the support upwardly, in a direction parallel to the warp ends and above them. At this point, the operator can move the heddles and yarn sideways past the intermediate support. The procedure is then reversed, swinging the cable and hollow member back down and into a vertical position. When the end plug is seated in the lower slotted holder, the tensioning means is employed to apply the desired tension to the cable.

A further object of the present invention is to provide an intermediate support that does not require the use of long slotted openings or excessively large holes in hollow frame staves which weaken them substantially.

A still further object of the present invention is to provide an intermediate support that does not require special tools to reach fasteners that are distant and situated in inaccessible or awkward locations on the weaving heddle frame.

Other objects, features, and advantages of the present invention will become apparent from the following description when taken in conjunction with the accompanying drawing wherein like characters of reference designate corresponding parts throughout the several views.

DETAILED DESCRIPTION OF THE PREFERRED EMBODIMENT

Figure 1:
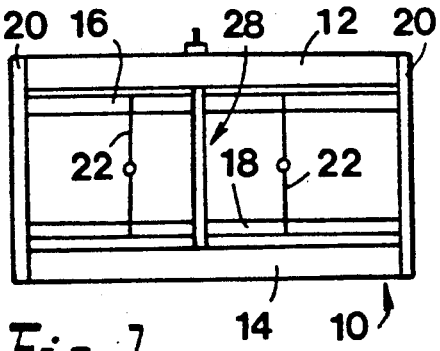
FIG. 1 is an elevation view of a weaving heddle frame with an intermediate support according to the present invention.

Referring now to the drawings, the intermediate support of the present invention is denoted generally by the reference numeral 28. As illustrated in FIG. 1, a weaving heddle frame includes an upper frame stave 12, a lower frame stave 14, an upper heddle carrying rod 16 connected to the upper frame stave 14, a lower heddle carrying rod 18 connected to the lower frame stave 14, two end stays 20, and an intermediate support 28 for maintaining the upper and lower frame staves in parallel relationship so that heddles 22 can slide along the rods 16, 18.

Figure 2:
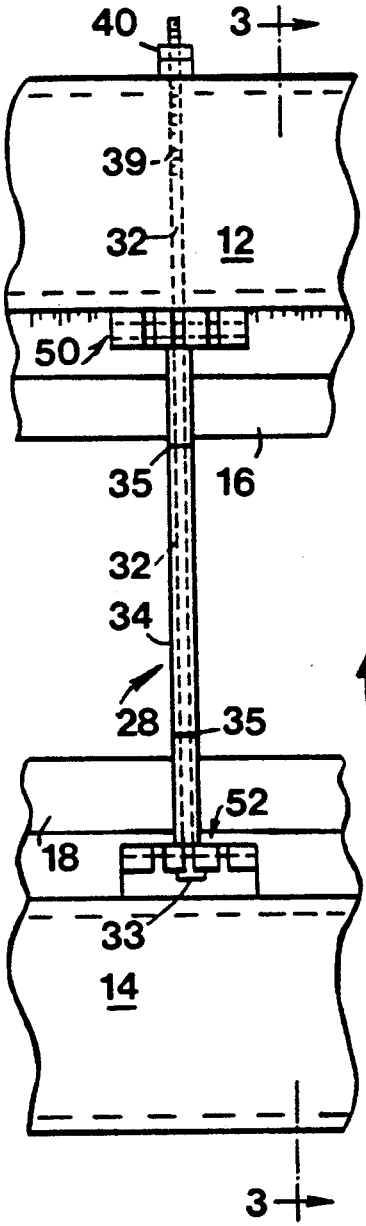
FIG. 2 is an enlarged view of a fragmentary section of a weaving heddle frame with an intermediate support according to the present invention.
Figure 3:
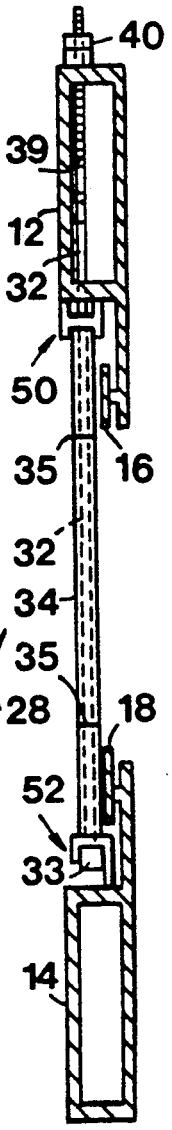
FIG. 3 is a cross section 3—3 through the weaving heddle frame in FIG. 2.

As is best seen in FIGS. 2 and 3, the intermediate support 28 comprises a flexible cable 32 surrounded by a rigid hollow member 34. Slotted holders 50 and 52 for receiving the cable 32 are fixedly attached to the upper and lower frame staves 12 and 14, respectively (FIGS. 2 and 3). During a weaving operation, the cable 32 is disposed within slots 54 in the holders 50, 52 and stretched perpendicular to the upper and lower frame staves 12 and 14. The distal ends of the cable 32 are connected to an end plug 33 and to a threaded plug 39 threadedly engageable with nuts 40 on the top of the upper frame stave 12. At the same time the threaded plug 39 is engaged by the nuts 40, the end plug 33 can be seated in the lower holder 52. Tension can be applied to the cable 32 by turning the nuts 40 so as to raise the end plug 33 against the lower holder 52.

The rigid hollow member 34 includes a plurality of rigid hollow segments. In the preferred embodiments, three segments, the middle one of which is substantially longer than the other two, are employed (FIGS. 2 through 6). When assembled to form the member 34, contiguous pairs of these segments abut each other at junctures 35. When tension is applied to the cable 32, the lower frame stave 14 is raised upward toward the upper frame stave 12. The minimum spacing between the staves 12 and 14 is determined by the length of the member 34. As the upper frame stave 12 is forced downward bringing the holder 50 into actual contact with the upper end of the rigid hollow member 34, the holder 52 on the lower frame stave 14 is forced upward against the lower end of the member 34. The tension forces in the cable 32 are then balanced by the compressive forces being exerted on the rigid hollow member 34, holding the staves 12 and 14 a predetermined distance apart. When this distance is properly set, the heddles 22 can be slid freely, without binding, along the rods 16 and 18.

Figure 13:
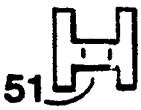
FIG. 13 is an end view of the upper holder according to FIG. 11.
Figure 14:
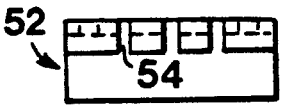
FIG. 14 is an enlarged elevation view of a lower holder which in use is fixedly attached to the lower frame stave, the lower holder having slots for receiving the cable in the intermediate support according to the present invention.
Figure 16:
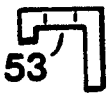
FIG. 16 is an end view of the lower holder according to FIG. 14.

As illustrated in FIGS. 13 and 16, both the upper and lower holders 50, 52 have recesses 51, 53 formed on their undersides, respectively. The upper end of the rigid hollow member 34 is seated in the recess 51 when tension is applied to the flexible cable 32 (FIGS. 3 and 13). Similarly, the end plug 33 is seated in the recess 53 when such tension is applied (FIGS. 3 and 16).

Figure 8:
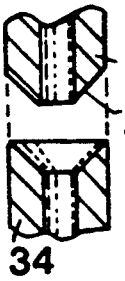
FIGS. 8–10 show cross sectional views of fragmentary sections of three different embodiments of the ends for contiguous pairs of rigid hollow segments in the intermediate support according to the present invention.
Figure 9:
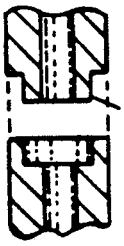
Figure 10:
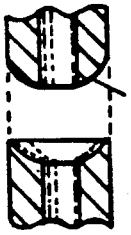
Figure 12:
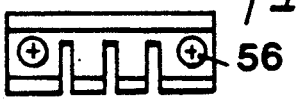
FIG. 12 is a plan view of the upper holder according to FIG. 11.
Figure 15:
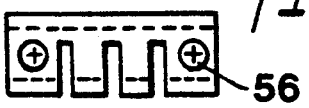
FIG. 15 is a plan view of the lower holder according to FIG. 14.
Figure 11:
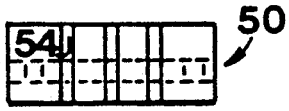
FIG. 11 is an enlarged elevation view of an upper holder which in use is fixedly attached to the upper frame stave, the upper holder having slots for receiving the cable in the intermediate support according to the present invention.

Further, the ends of contiguous segments of the rigid hollow member 34 can be nested and are so shaped that under tension, the longitudinal axes of the segments are aligned with each other (FIGS. 8 through 10). Preferably, upon such alignment, the outer surfaces of contiguous segments of the rigid hollow member 34 are flush at the junctures 35 as well. Each of the preferred embodiments of the segments of the member 34 depicted in FIGS. 8 through 10 meets a critical requirement for an intermediate support: namely, that when the warp ends carried by an adjacent frame 10 are raised or lowered in the weaving process, they must not hang or catch on the intermediate support.

Specifically, as depicted in FIG. 8, one nestable end 36 of the contiguous segments forming the rigid hollow member 34 has a convex taper and the other nestable end a concave taper. In FIG. 9, an alternate configuration utilizing nestable ends, one of which has a step shape 37, is employed. A further embodiment is shown in FIG. 10 in which one of the nestable ends has an oval shape 38. In each of these embodiments, the nestable ends are shaped and sized to insure the alignment of the longitudinal axes of the rigid hollow segments when compression forces are applied to the member 34 at the same time the cable 32 is being stretched.

Means for positioning the cable relative to the staves 12, 14 includes a plurality of narrow vertical slots 54. The slots 54 which receive the cable 32 are formed in each of the holders 50, 52. In the preferred embodiment, each of the holders 50, 52 has at least three slots which are spaced a uniform distance apart (FIGS. 11, 12, 14, 15). Pairs of slots 54 in the holders 50, 52 are aligned vertically with each other. When the cable 32 is located in a pair of slots 54 in the holders 50, 52 which are vertically aligned, the intermediate support 28 is disposed approximately perpendicular to both the upper and lower frame staves 12 and 14. The plurality of slots 54 in each of the holders 50, 52 allows the intermediate support 28 to be shifted transversely along the staves 12, 14, without losing it perpendicularity with respect to them. An installer need simply insert the cable 32 in the desired vertically aligned pair of slots 54.

Fasteners such as screws (not shown) which are insertable in holes 56 in the holders 50 and 52 are employed to secure them to the underside of the upper frame stave 12 and to the upper edge of the lower frame stave 14, respectively.

Figures 4, 5, 6, 7:
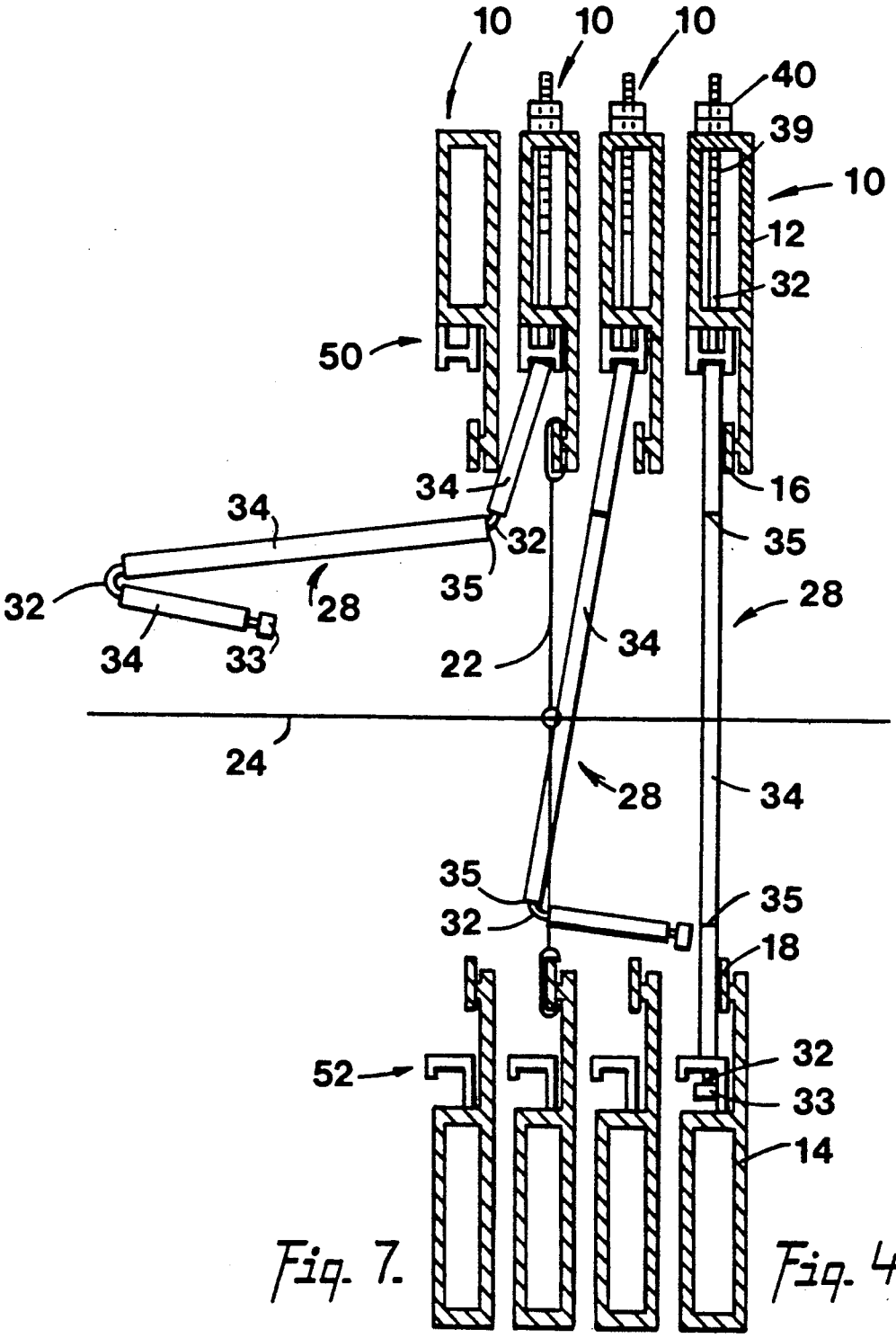
FIG. 4 is a cross section similar to that in FIG. 3 but on an enlarged scale and with the intermediate support loosened.
FIG. 5 is a cross section similar to that in FIG. 4 except that the intermediate support is in a flexed position.
FIG. 6 is a cross section similar to that in FIG. 4 except that the intermediate support has been swung upward and above the warp ends.
FIG. 7 is a cross section similar to that in FIG. 4 except that the intermediate support has been removed.

FIGS. 4 through 7 depict weaving heddle frames 10 in close proximity to each other as they are used in a weaving loom. When the heddles 22 must be slid along the rods 16 and 18 past the intermediate support 28, the nuts 40, on the top of the upper frame stave 12, are first loosened. As the nuts 40 are being loosened, the threaded plug 39 is moved downwardly, causing the end plug 33 to drop out of the lower holder 52 (FIG. 4). The plug 33 is then swung free of the holder 52. The slackness of the flexible cable 32 at this stage is sufficient to allow it to be bent at an angle of approximately 90 degrees at one of the junctures between contiguous segments of the member 34, so that the lower portion of the member 34 can be swung over the lower heddle carrying rod 18 on the adjacent weaving heddle frame 10 (FIG. 5). Once the intermediate support 28 has been swung upwardly even further to points above the level of the warp yarn end 24 and away from the upper heddle carrying rod 16, the heddle 22 can be slid along the rods 16 and 18, thereby moving the warp end 24 past the intermediate support 28 (FIG. 6).

It will be obvious to those skilled in the art that many variations may be made in the preferred embodiments, chosen for the purpose of illustrating the best mode of making and using the present invention, without departing from the scope thereof as defined by the appended claims.

What is claimed is:

1. In a weaving heddle frame having upper and lower frame staves, the combination with said frame staves of an intermediate support having:

(a) a flexible cable connected to the upper frame stave;

(b) a rigid hollow member surrounding a portion of the cable and extending generally from the upper edge of the lower frame stave to the lower edge of the upper frame stave;

(c) means for detachably mounting the lower end of the cable on the lower frame stave; and (d) means disposed at the upper end of the cable for tensioning the cable, the tensioning means transmitting tensile force in the cable to urge the lower frame stave upward into contact with the lower end of the hollow member and the upper frame stave downward into contact with the upper end of the hollow member while the rigid hollow member exerts compressive force simultaneously upon the upper and lower staves to hold them in a spaced apart relationship.

2. An intermediate support for a weaving heddle frame having upper and lower frame staves, the frame being adapted for to-and-fro movement, comprising:

(a) a flexible cable connected to the upper frame stave;

(b) a rigid hollow member comprising a plurality of rigid hollow segments, the rigid hollow member surrounding a portion of the cable and extending generally from the upper edge of the lower frame stave to the lower edge of the upper frame stave;

(c) means for detachably mounting the lower end of the cable on the lower frame stave; and (d) means disposed at the upper end of the cable for tensioning the cable, the tensioning means transmitting tensile force in the cable to urge the lower frame stave upward into contact with the lower end of the hollow member and the upper frame stave downward into contact with the upper end of the hollow member while the rigid hollow member exerts compressive force simultaneously upon the upper and lower staves to hold them in a spaced apart relationship during the to-and-fro movement of the weaving heddle frame.

3. The intermediate support according to claim 2 which further comprises means, disposed on the ends of each pair of rigid hollow segments which are situated contiguous with each other, for nesting said ends so that one of the ends can be disposed within the other, the longitudinal axes of the rigid hollow segments being aligned with each other when the ends of each of the contiguous pairs of segments are nested.

4. The intermediate support according to claim 2 wherein the connecting means comprises an end plug affixed to the lower end of the cable and a lower holder attached to the lower frame stave, the lower holder having a slot and a recess for receiving the cable and the end plug, respectively; the slot and the recess communicating with each other, so that when the cable is seated within the slot and pulled upwardly to a sufficient extent, the end plug seats itself in the recess.

5. The intermediate support according to claim 4 wherein the connecting means further comprises a first holder secured to the lower frame stave, the first holder having a plurality of vertical slots for receiving the cable.

6. The intermediate support according to claim 5 which further comprises a second holder mounted on the upper frame stave, the second holder having a plurality of vertical slots for receiving the cable, each of the slots in the first holder being aligned vertically with one of the slots in the second holder, thereby facilitating the alignment of the cable in a position in which the cable is disposed perpendicular to the upper and lower frame staves.

7. The intermediate support according to claim 2 wherein the cable tensioning means further comprises a threaded plug connected to the upper end of the cable and means affixed to the upper frame stave for engaging the threaded plug.

8. An intermediate support for a weaving heddle frame having upper and lower frame staves comprising:

(a) a flexible cable connected to the upper frame stave;

(b) a rigid hollow member including more than one rigid hollow segment, each segment surrounding a portion of the cable, the rigid hollow member being extendable, when the longitudinal axes of the rigid hollow segments are aligned with each other, generally from the upper edge of the lower frame stave to the lower edge of the upper frame stave;

(c) means for detachably mounting the lower end of the cable on the lower frame stave; and (d) means disposed at the upper end of the cable for tensioning the cable, the tensioning means transmitting tensile force in the cable to urge the lower frame stave upward into contact with the lower end of the lowermost hollow segment and the upper frame stave downward into contact with the upper end of the uppermost hollow segment, thereby exerting compressive and tensile forces simultaneously upon the upper and lower frame staves to hold them in a spaced apart relationship.

* * * * *